US010843774B2

(12) United States Patent
Muller

(10) Patent No.: US 10,843,774 B2
(45) Date of Patent: Nov. 24, 2020

(54) MOVABLE FIN ASSEMBLY

(71) Applicant: Luke Barry Burnett Muller, Durban (ZA)

(72) Inventor: Luke Barry Burnett Muller, Durban (ZA)

( * ) Notice: Subject to any disclaimer, the term of this patent is extended or adjusted under 35 U.S.C. 154(b) by 90 days.

(21) Appl. No.: 16/256,122

(22) Filed: Jan. 24, 2019

(65) Prior Publication Data

US 2019/0233062 A1 Aug. 1, 2019

(30) Foreign Application Priority Data

Jan. 26, 2018 (ZA) ..... 2018/00546

(51) Int. Cl.
*B63B 35/79* (2006.01)
*B63B 32/66* (2020.01)

(52) U.S. Cl.
CPC ..... *B63B 32/66* (2020.02)

(58) Field of Classification Search
CPC ..... B63B 32/60; B63B 32/66; B63B 32/64
See application file for complete search history.

(56) References Cited

U.S. PATENT DOCUMENTS 6,386,933 B1 * 5/2002 Rewald ..... B63B 32/66 441/74
8,408,958 B2 * 4/2013 Benham ..... B63B 32/60 441/79
2004/0242093 A1 * 12/2004 Geraghty ..... B63B 32/66 441/79

* cited by examiner

*Primary Examiner* — Andrew Polay
(74) *Attorney, Agent, or Firm* — The Roy Gross Law Firm, LLC; Roy Gross

(57) ABSTRACT

The invention relates to a movable fin assembly, which includes a housing attachable to an underside of a watercraft and a rotation and pivoting mechanism. The mechanism positioned inside the housing and movable about two axes of rotation. The mechanism further has a fin locating position, thereby a fin provided at the fin locating position is capable of moving about the two axes of rotation via the mechanism, such that the fin's toe angle and camber angle changes when moving through the water. The invention further extends to an interchangeable self-aligning fin and static fin kit which includes a rotation and pivoting mechanism and a static member shaped and dimensioned to correspond with an interior of the housing. The static member and the rotation and pivoting mechanism interchangeably receivable by the housing in order to selectively provide a dynamic or static fin on the underside of the watercraft.

11 Claims, 8 Drawing Sheets

MOVABLE FIN ASSEMBLY

CROSS REFERENCE TO RELATED APPLICATIONS

This application claims the benefit of South African Provisional Patent Application No. 2018/00546 filed on 26 Jan. 2018. The content of the above application is all incorporated by reference as if fully set forth herein in its entirety.

FIELD OF THE INVENTION

This invention relates to a fin assembly for surfboards and other watercrafts. In particular, the invention relates to a movable fin assembly for use with surfboards and other watercrafts.

BACKGROUND OF THE INVENTION

Conventional fins and rudders, in basic form, are thin, flat shaped pieces of material and are used to steer and stabilise larger watercrafts. Various watercrafts make use of rudders or fins, and even surfboards, which make use of fins for steering and stability. Initially, surfboards had no fins and these early boards would often slip sideways, or change direction unexpectedly, causing a surfer to lose control.

The introduction of a fixed fins provided both stability and control which revolutionised the sport of surfing. The feature went from being increasingly common to the universal standard and now there are numerous configurations available, the three fin (thruster) design being considered the dominant fin configuration for both casual and competitive surfing.

As surfing often requires abrupt changes in direction, the toe angels and fin camber need to be variables. A change in the fin's camber and toe angles allow for different phases of trajectory as well as changing the surfboard's responsiveness to a suffers movements and the level of water resistance.

The inventor is aware of the hydrodynamic problems relating to surfboards and aims to provide a solution to the problem through this invention.

SUMMARY OF THE INVENTION

Broadly according to a first aspect of the invention there is provided a movable fin assembly, which includes:

a housing attachable to an underside of a watercraft, the housing having a hollow interior; and a rotation and pivoting mechanism positioned inside the housing, the rotation and pivoting mechanism movable about two axes of rotation, the rotation and pivoting mechanism having a fin locating position, thereby a fin provided at the fin locating position of the mechanism, capable of moving about the two axes of rotation via the mechanism, such that the fin's toe angle and camber angle changes when moving through the water.

The rotation and pivoting mechanism may be restricted to only be movable about two axes, one axis extending transversely from the watercraft surface, in order to change the fin's toe angle, and the other axis parallel to the watercraft surface, in order to change the fin's camber angle.

The watercraft may be the form of a surfboard, a paddleboard or the like.

The rotation and pivoting mechanism may be shaped and dimensioned to correspond to confines of the housing's hollow interior thereby to allow the mechanism to rotate about a first axis and pivot about a second axis. In one embodiment of the invention the rotation and pivoting mechanism may be in the form of a circular member with the housing's hollow interior shaped to define a corresponding socket such that the housing and mechanism represents a ball and socket joint. The socket may be shaped to restrict the movement of the rotation and pivoting mechanism within a predetermined range.

The movable fin assembly may include guiding means, which in use confines the movement of the rotation and pivoting mechanism between predefined angles in order to restrict a fin's camber and toe angle.

The fin locating position may be defined as the position at which the fin extends from the rotation and pivoting mechanism.

In one embodiment the fin and the rotation and pivoting mechanism may be of unitary construction, in such an embodiment the fin extends from the rotation and pivoting mechanism at the fin locating position.

In another embodiment in which the fin is detachable from the rotating and pivoting mechanism, the mechanism may include a fin attachment formation at the fin locating position allowing a fin to be attached to the rotating and pivoting mechanism. The fin attachment formation may be in the form of at least one receptacle capable of receiving at least one protuberance located on an underside of the fin.

The rotation and pivoting mechanism may have two movable members with the fin locating position located on at least one of the members. A first member may be rotatable about one axis and a second member rotatable with the first member about said axis and also independently rotatable about another axis such that the fin provided at the fin locating position is movable about two axes of rotation.

The second member may be shaped and dimensioned to fit inside the first member such that in use, the second member rotates with the first member as well as being independently movable about a first axis extending along the length of the first member.

The first member may be shaped and dimensioned to correspond to confines of the housing's hollow interior thereby to allow the mechanism to rotate about a second axis extending transversely from the underside of the watercraft. The first member may further have a cavity into which the second member is receivable.

A lower section of the cavity may have a semi-circular shape, with a lower section of the second member having a corresponding rounded shape to decrease the friction between the first and second member when the second member rotates inside the first member.

The fin locating position may be located on the second member such that in use, the fin is movable about the first and second axis in order to change the toe angle and camber angle of the fin.

In one embodiment the housing may be recessed into a cavity in the underside of the watercraft in order to decrease the drag between the water and the housing when the watercraft is in use.

The housing may have a planar base with a transversely extending outer rim which defines the hollow interior in which the rotating and pivot mechanism is positioned.

The guiding means may include rotation guiding means, which are in the form of step formations extending on each inner side of transversely extending outer rim along the length of the housing.

The step formations may increase in width towards a centre point to allow both ends of the rotation and pivoting mechanism to move sideward between the step formation, thereby allowing the mechanism to rotate about a central transverse axis between predefined angles.

The cavity in the first member may include a guide slot located in an upper face of the first member, the guide slot defines pivoting guiding means and forms part of the guiding means.

The second member may include at least one protuberance extending from an operative upper section of the second member which defines a guiding formation. The at least one protuberance operable to slide into the guide slot which restricts the degree of rotation of the second member.

The housing may include one or more covers for securing the rotation and pivoting mechanism inside the hollow interior of the housing. The one or more covers may provide a slot through which a fin provided at the fin locating position of the rotation and pivoting mechanism extends towards an outside of the housing.

The one or more cover may include holding formations in order to secure the one or more covers to the housing.

In one embodiment of the invention, the holding formations may be in the form of snap fittings which corresponds with apertures in the housing. In another embodiment the holding formations may be in the form of screws receivable into corresponding apertures in the one or more covers and the housing.

In one embodiment the housing may include a single cover having a slot extending the length of the cover through which the fin attached to the rotation and pivoting mechanism extends towards an outside of the housing.

In a preferred embodiment the housing may include two covers each secured to a side of the housing, the two covers shaped to provide a slot between each other through which the fin attached to the rotation and pivoting mechanism extends towards an outside of the housing.

The rotation and pivoting mechanism may include a raised section located on an underside of the rotation and pivoting member such that once the rotation and pivoting mechanism is received inside the housing the raised will reduce the rotational friction between the rotation and pivoting mechanism and the housing.

The movable fin assembly may further include an end piece which is rounded to fit inside the front or rear section of the housing. The end piece may include a rounded lip which extends perpendicular away from the end piece. The rounded lip may be shaped to be received by a groove in the second member allowing the second member to freely rotate.

Broadly according to a second aspect of the invention there is provided an interchangeable self-aligning fin and static fin kit which includes a movable fin assembly as described, in which the rotation and pivoting mechanism is removable from the housing; and a static member, which is shaped and dimensioned to correspond with the interior of the housing and can replace the rotation and pivoting mechanism in order to restrict movement, the static member and rotation and pivoting mechanism interchangeably receivable by the housing in order to selectively provide a dynamic or static fin on the underside of the watercraft.

The static member of the interchangeable self-aligning fin and static fin kit may be shaped and dimensioned to form a tight fit with the housing to restrict the movement of the static member such that the fin's camber angle and toe angle does not change in use.

The static member may have a fin locating position, in one embodiment the fin and the static member may be of unitary construction, in such an embodiment the fin extends from the fin locating position. In another embodiment in which the fin is detachable from the static member, the static member may include a fin attachment formation at the fin locating position allowing a fin to be interchangeably attached to the static member and the rotating and pivoting mechanism. The fin attachment formation may be in the form of at least one receptacle capable of receiving at least one protuberance on an underside of the fin Broadly according to a third aspect of the invention there is provided a surfboard, which includes a board; and at least one movable fin assembly as described, attached to the underside of the board, such that a fin provided at the fin locating position extends from the underside of the board and is rotatable via the movable fin assembly about at least two rotation axes.

The surfboard may include three movable fin assemblies attached to the board. The rotation and pivoting mechanisms of each movable fin assembly may be removable. The surfboard may further include one or more static members, which are shaped and dimensioned to correspond with the interior of the housing and can replace any one or more of the rotation and pivoting mechanisms in order to restrict fin movement.

The static members and rotation and pivoting mechanisms may be interchangeably receivable by the movable fin assembly housings in order to selectively provide dynamic, static or a combination of dynamic and static fins on the underside of the surfboard.

The invention is now described, by way of non-limiting example, with reference to the accompanying drawings:

BRIEF DESCRIPTION OF THE DRAWINGS

In the figure(s).

In the drawings, like reference numerals denote like parts of the invention unless otherwise indicated.

EMBODIMENT OF THE INVENTION

Figure 1:
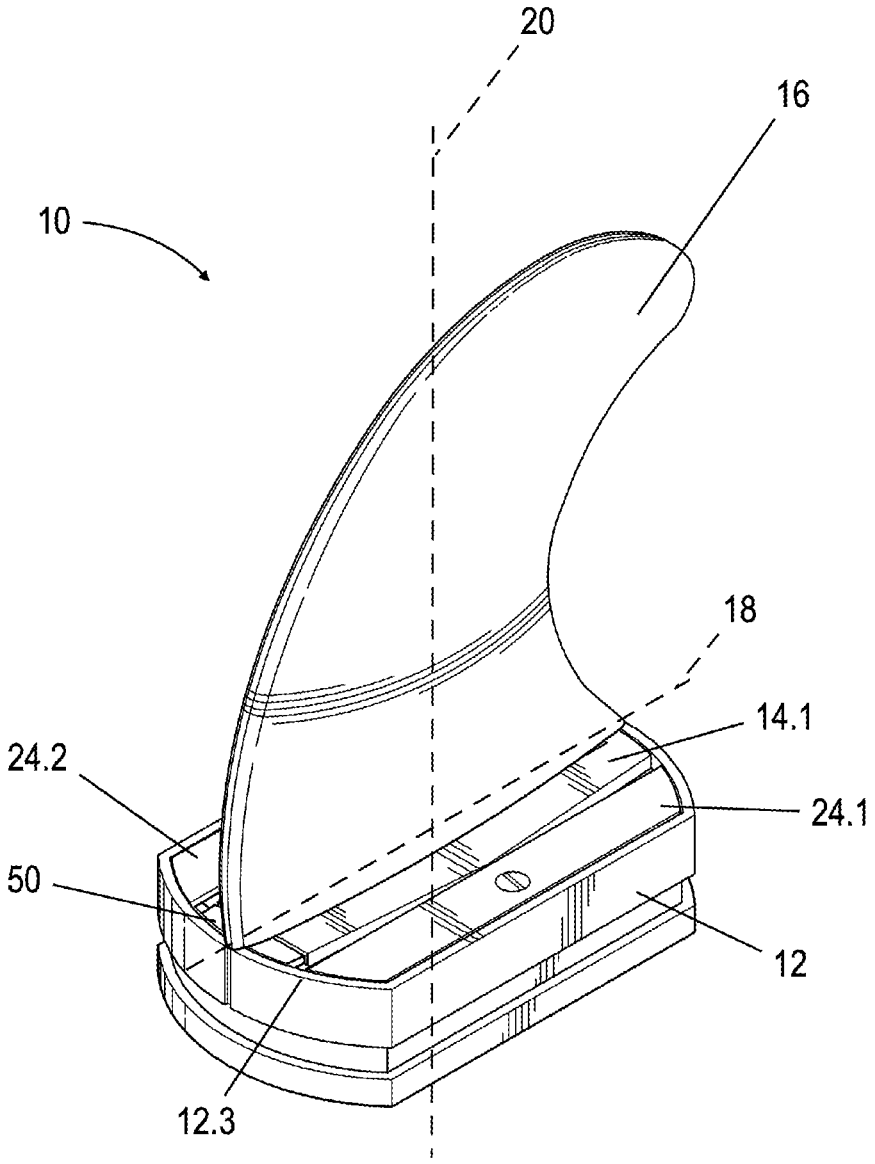
FIG. 1 shows a three-dimensional view of a movable fin assembly.

In FIG. 1 reference numeral (10) refers to a movable fin assembly which includes a housing (12) and a rotation and pivoting mechanism (14) positioned inside the housing (12). The housing includes a bottom face (12.1) which in use is attached to the underside of a watercraft (not shown).

Figure 5:
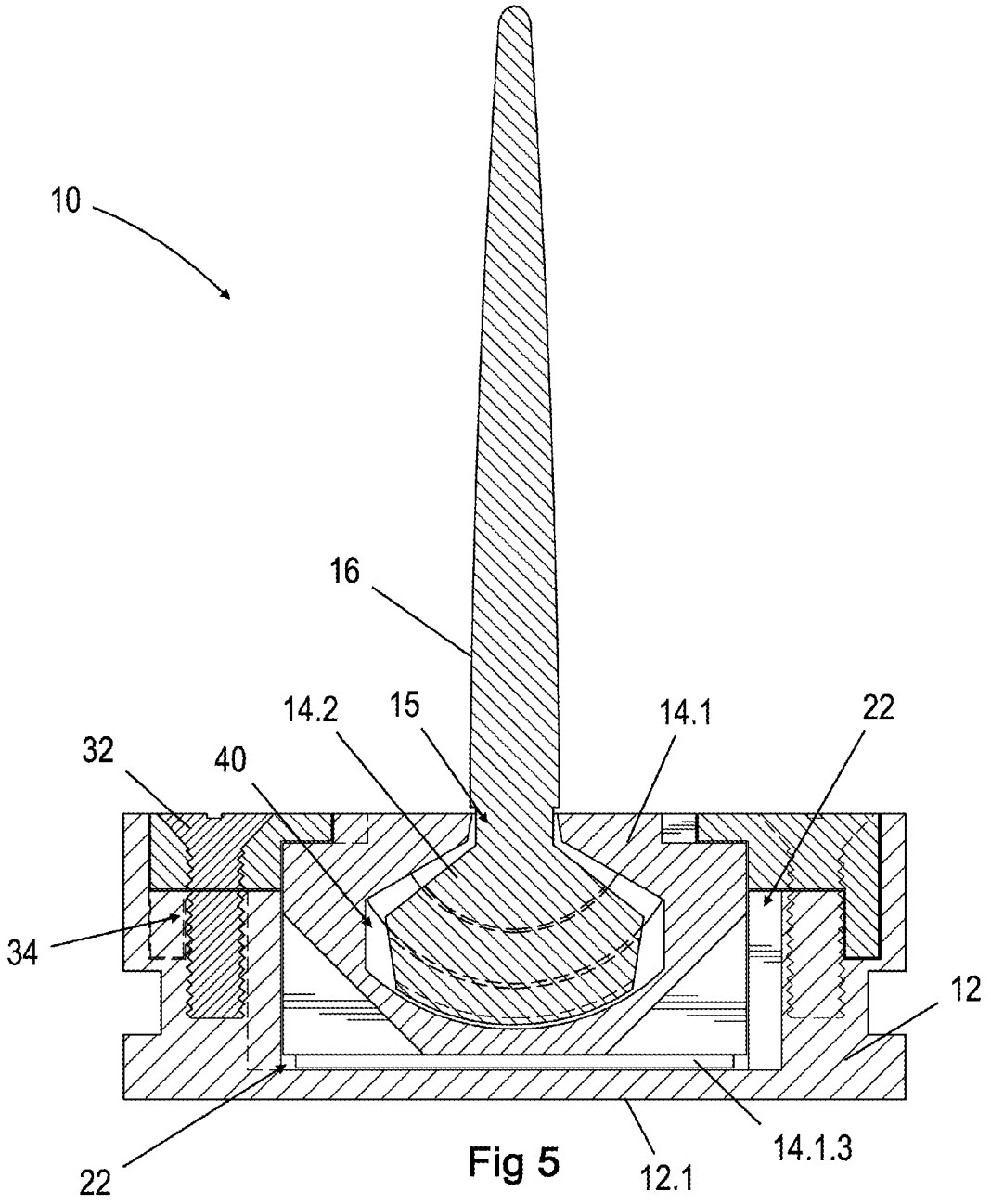
FIG. 5 shows a sectional view of the self-aligning fin kit with a unitarily formed fin.

The movable fin assembly (10) further includes a fin (16) which is attached to the rotation and pivoting mechanism (14), at the fin locating position (15), and extends from the housing (12). In this example, the fin (16) is detachable from the rotation and pivoting mechanism (14) but as shown in FIG. 5 the fin (16) may be of unitary construction with the rotation and pivoting mechanism (14) and extend from the fin locating position (15).

The rotation and pivoting mechanism (14) is shaped and dimensioned to rotate about a first axis (18), which is parallel to the watercraft, and a second axis (20) which is perpendicular to the underside of the watercraft. The rotation and pivoting mechanism allows the fin (16) to pivot about the first rotational axis (18), in order to change the fin's toe angle and to rotate about the second axis (20) in order to change the fin's (16) camber angle.

Figure 2:
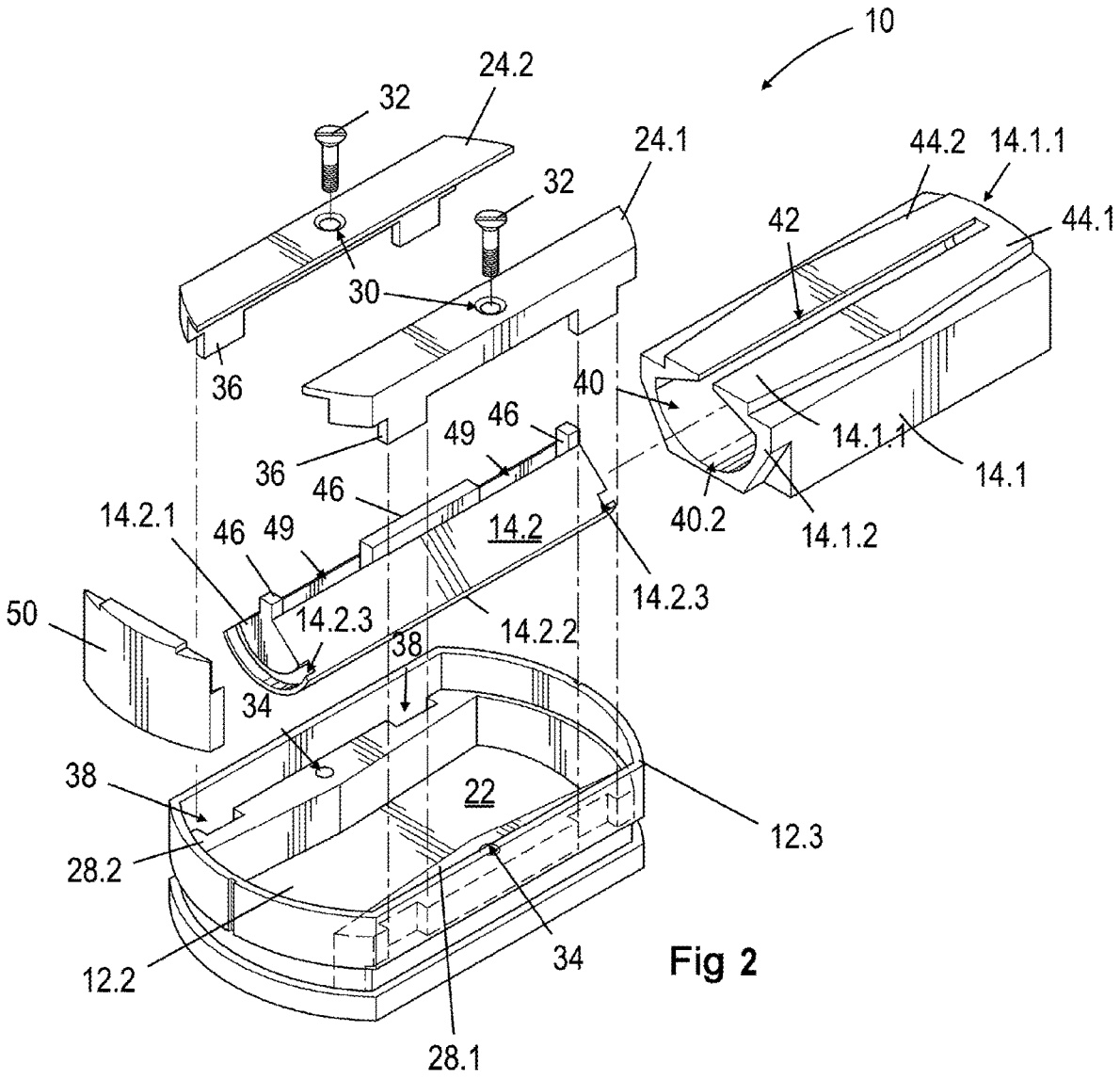
FIG. 2 shows an exploded view of a movable fin assembly as shown in FIG. 1.
Figure 3:
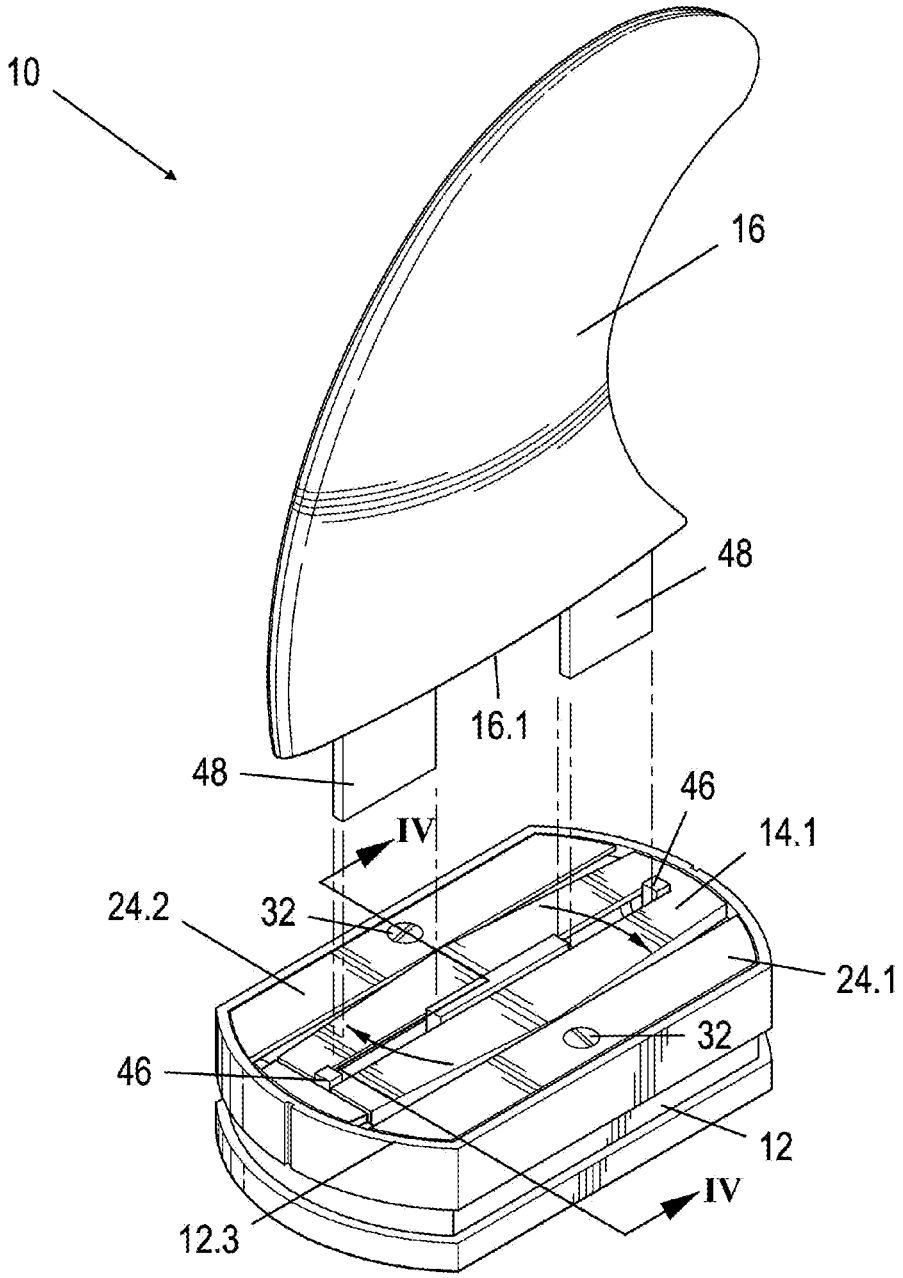
FIG. 3 shows a three-dimensional view of a self-aligning fin kit with a fin detached.
Figure 4:
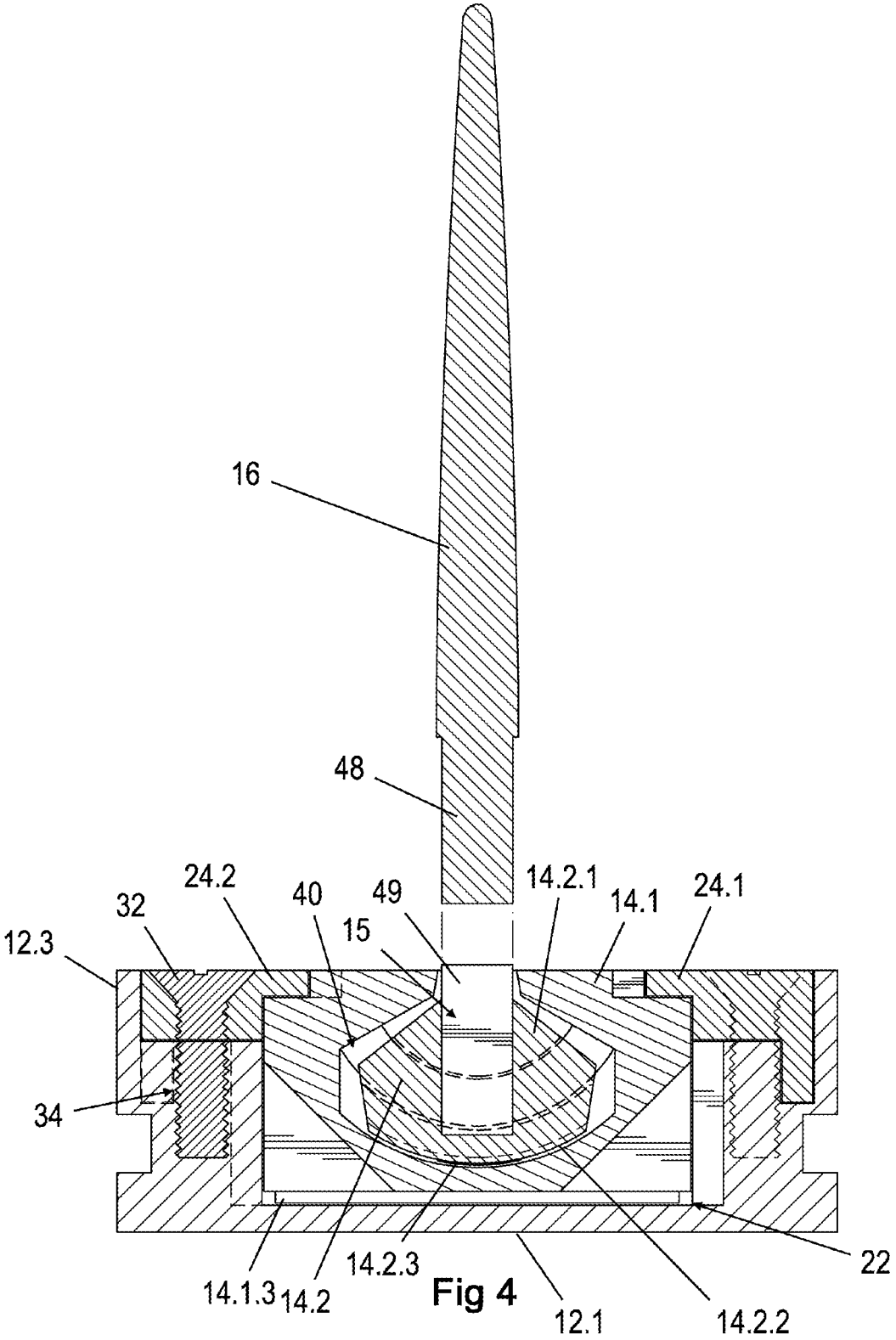
FIG. 4 shows a sectional view of the self-aligning fin kit with a detachable fin as shown in FIG. 3.

In FIG. 2 the movable fin assembly (10) is shown in an exploded view. The rotation and pivoting mechanism (14) includes a first member (14.1) and a second member (14.2), with the second member (14.2) positioned within the first member (14.1). In use, the second member (14.2) rotates along with the first member (14.1), when the first member (14.1) rotates about the second axis (20). The second member (14.2) is also able to rotate independently from the first member, about the first axis (18), within the first member (14.1). The fin (16) is attached to the second member (14.2) such that in use the fin can both pivot about the first axis (18) and rotate about the second axis (20).

The housing (12) includes a planar base structure (12.2) with an extending outer rim (12.3), the base structure (12.2) and extending outer rim (12.3) defining the housing's hollow interior (22) into which the rotation and pivot mechanism (14) is positioned.

The movable fin assembly (10) further includes two covers (24.1, 24.2) to secure the rotation and pivot mechanism (14) in the housing, once the mechanism is received into the hollow interior (22) of the housing (12). The covers (24.1, 24.2) are positioned to provide an opening (26) between each other, through which the fin (16) projects from the rotation and pivot mechanism (14).

The housing (12) further includes two supporting steps (28.1, 28.2), which are integrally formed along the length of the hollow interior of the housing (22), onto which the two covers (24.1, 24.2) are attached. The supporting steps (28.1, 28.2) increase in thickness towards a central point, which allows both ends of the first member (14.1) to move sideways such that the second axis (20) is centrally aligned with the housing.

Each one of the covers (24.1, 24.2) includes a countersink hole (30) into which a countersunk screw (32) is placed and secured into a central threaded aperture (34) located inside each supporting step (28.1, 28.2). Each cover plate (24.1, 24.2) further includes alignment formations (36) which are defined by two projections (36.1, 36.2) which are dimensioned to be received by two slot formations (38) in each supporting step (24.1, 24.2). In use, once the rotation and pivot mechanism (14) is placed inside the housing (12) the covers (24.1, 24.2) are secured to the supporting step (28.1, 28.2) in order to secure the mechanism (14) within the hollow interior of the housing (22).

The first member (14.1) is in the shape of a cuboid with a rounded rear face (14.1.1) which is dimensioned to fit inside the housing (12), in use, the rounded rear face (14.1.1) ensures the first member (14.1) easily rotates inside the housing (12).

The first member (14.1) further includes a raised section (14.1.3) located on a bottom face (14.1.2) of the first member (14.1). The raised section (14.1.3) is in the form of a circular protuberance which decreases the surface area of the first member (14.1) which is in contact with the base structure (12.2) of the housing. In use, when the first member (14.1) is positioned inside the housing (12) the raised section (not shown) will abut the housings' base structure (12.2), thereby reducing the friction between the first member (14.1) and the housing (12). The raised section (14.1.3) further restricts the formation of a vacuum by allowing water to pass between the two parts as the watercraft moves through the water.

The first member (14.1) further includes a central cavity (40) with a circular shaped lower section (40.1). The central cavity (40) extends from an opening (40.2) in the first member's front face (14.1.2) through which the second member (14.2) is inserted into the central cavity (40).

The central cavity (40) includes a rectangular guide slot (42) located in an upper face of the rotating member (14.1). The guide slot (42) extends along the cavity (30) from the opening.

The first member (14.1) includes guiding means which confines the rotation of the member (14.1) within predefined angles. According to one embodiment of the invention, the rotation of the first member is restricted when protuberance sections (44.1, 44.2), located on each side of the guide slot (42), presses against an underside of the covers (24).

According to another embodiment of the invention, the guiding means is established by the shape and dimensions of the housing's interior (22) and the shape and dimension of the first member (14.1). In use, the first member (14.1) is capable of rotating to such an angle where the first member presses against one of the supporting steps (28). Therefore, the angle the first member is able to rotate can be adjusted by changing the shape and/or the dimension of the first member (14.1).

The second member (14.2) is shaped and dimensioned to fit through the opening (40.2) into the cavity (40). The second member includes an upper section (14.2.1) which has a substantially triangular form and a lower section (14.2.2) having a convex shape to match the shape of the cavity's lower section (40.2).

The second member's lower section (14.2.2) includes two protuberances (14.2.3) which once inserted decreases the surface area of the second member (14.2) which is in contact with the first member (14.1). In use, the decreased surface area will reduce the rotational friction between the members as well as allowing fluid to pass between the two members.

The second member (14.2) further includes three guiding formations (46) which extend from the member's upper section (14.2). The guiding formations (46) are shaped and dimensioned to be slidably received by the guide slot (42). The guide slot (42) and the guiding formations (46) establish a means for confining the movement of the second member (14.2). In use, once the second member (14.2) is inserted into the first member (14.1) the second member's degree of rotation is limited by the guiding formations (46) and the guide slot (42). The second member's degree of rotation is adjusted by adjusting the width of the guide slot (42).

The rotation and pivoting mechanism may include a fin attachment formation (49) located on an upper section (14.2.1) of the second member, which allows the fin to be attached (16) to the second member (14.2). The fin attachment formation (49) is defined by two receptacles (49), in the form of channels, which are capable of receiving two fin tabs (48) which project from a base (16.1) of the fin (16). The fin tabs (48) are then secured to the fin attachment formation (49) with the use of an adhesive.

In another embodiment as seen in FIG. 5, the fin (16) and the second member (14.1) are of uniform construction. This is done by moulding the second member (14.1) and the fin (16) as a singular part in order to increase the strength of the movable fin assembly (10).

The second member (14.2) further includes a semi-circular notch (14.2.3) in each opposed ends of the member (14.2). The notch (14.2.3) which is located in a rear face (of the member (14.2) is capable of receiving a rounded lip (not shown) which extends from a face located in the rear of the cavity (40)

The movable fin assembly (10) further includes a cap (50) which includes a rounded lip (not shown) capable of being received by the notch (14.2.3) in the second member's front face (14.2). In use, the cap (50) is placed against the front of the second member (14.2) after it is placed inside the cavity (40) of the first member (14.1) with the rounded lip (not shown) received into the notch (14.2.3) ensuring the first and second member rotates smoothly of the fin (18).

Figure 6:
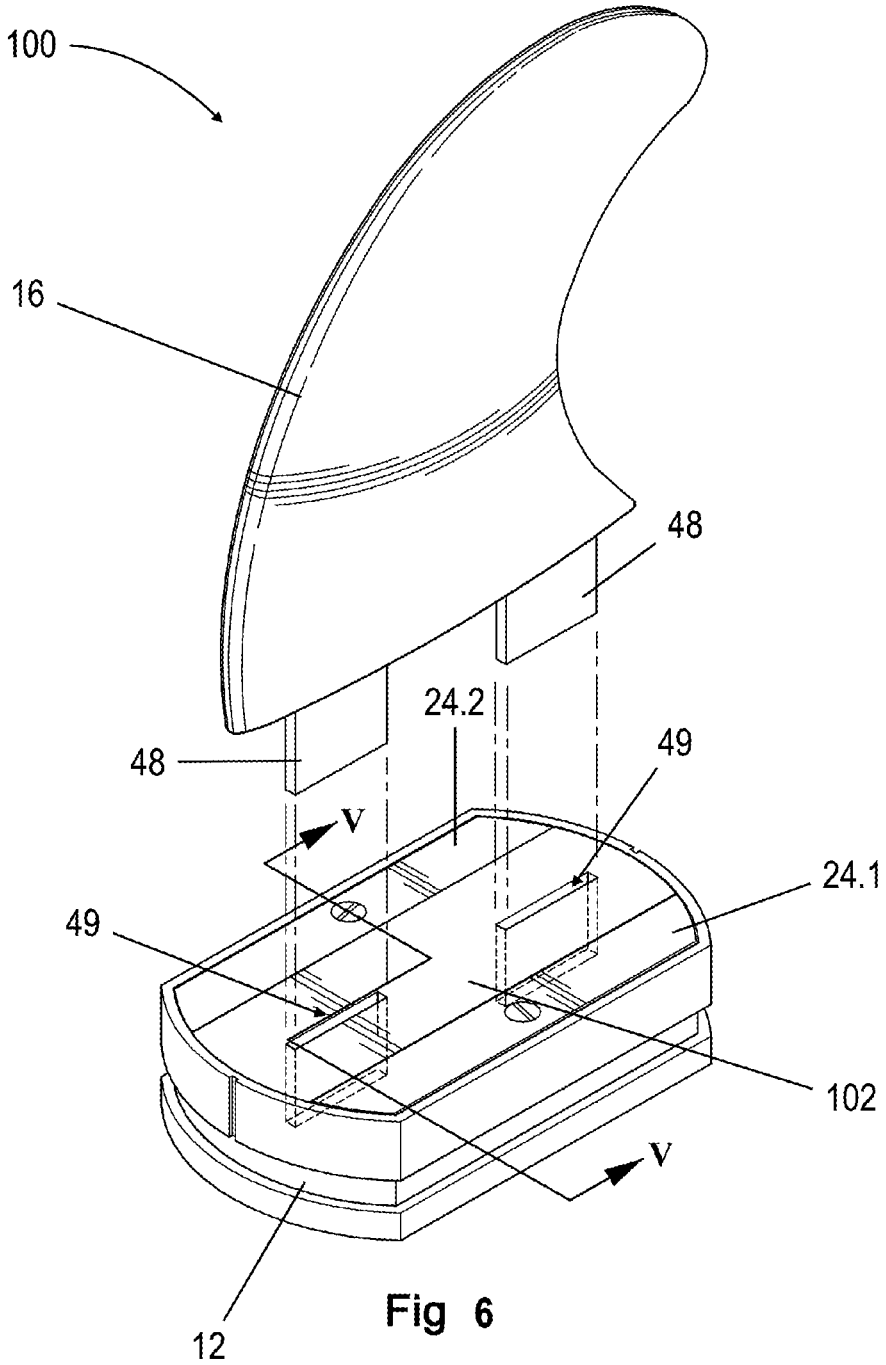
FIG. 6 shows a three-dimensional view of an interchangeable self-aligning fin and static fin kit with a stationary fin in use.
Figure 7:
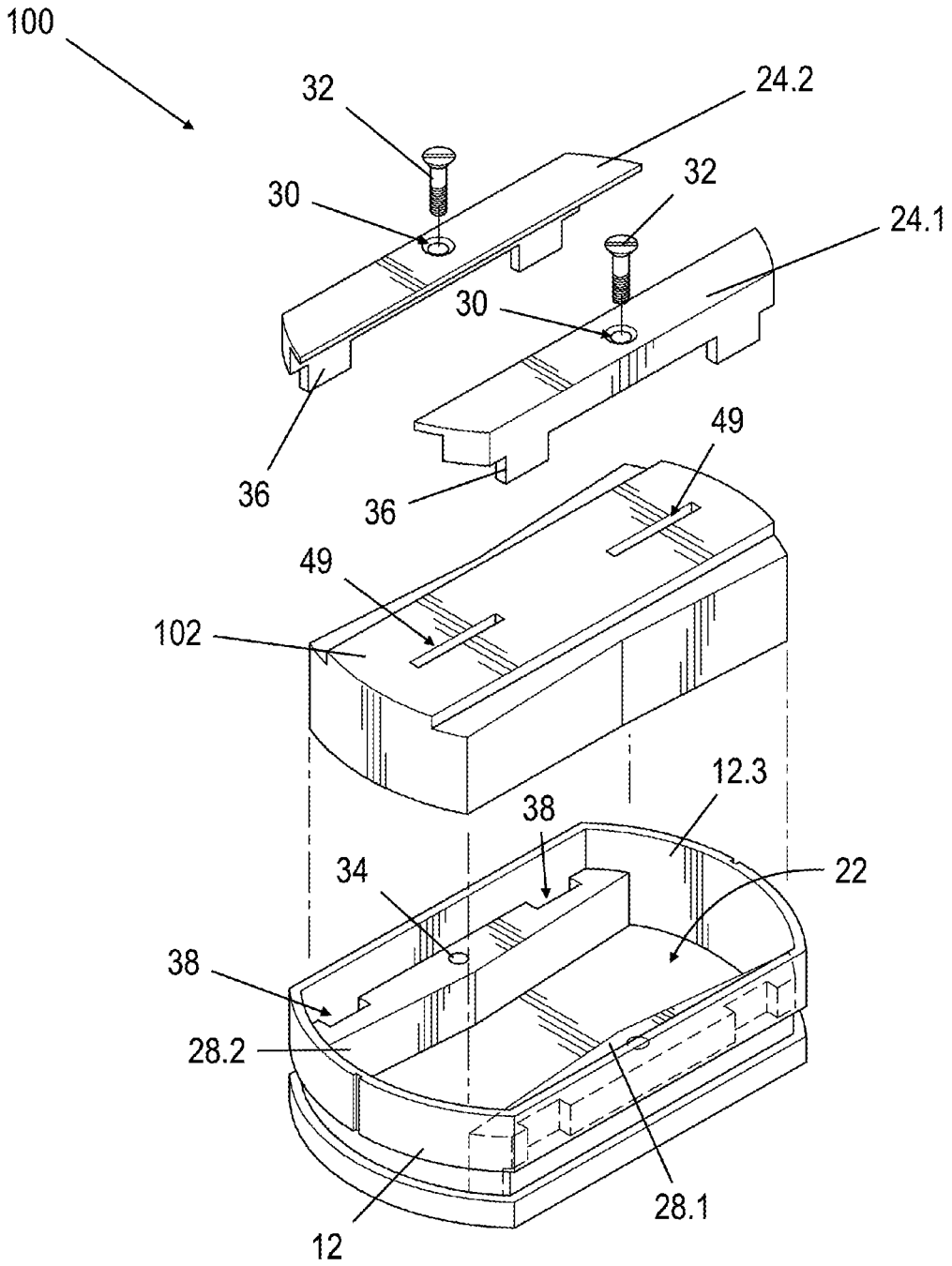
FIG. 7 an exploded view of the stationary fin as shown in FIG. 6.
Figure 8:
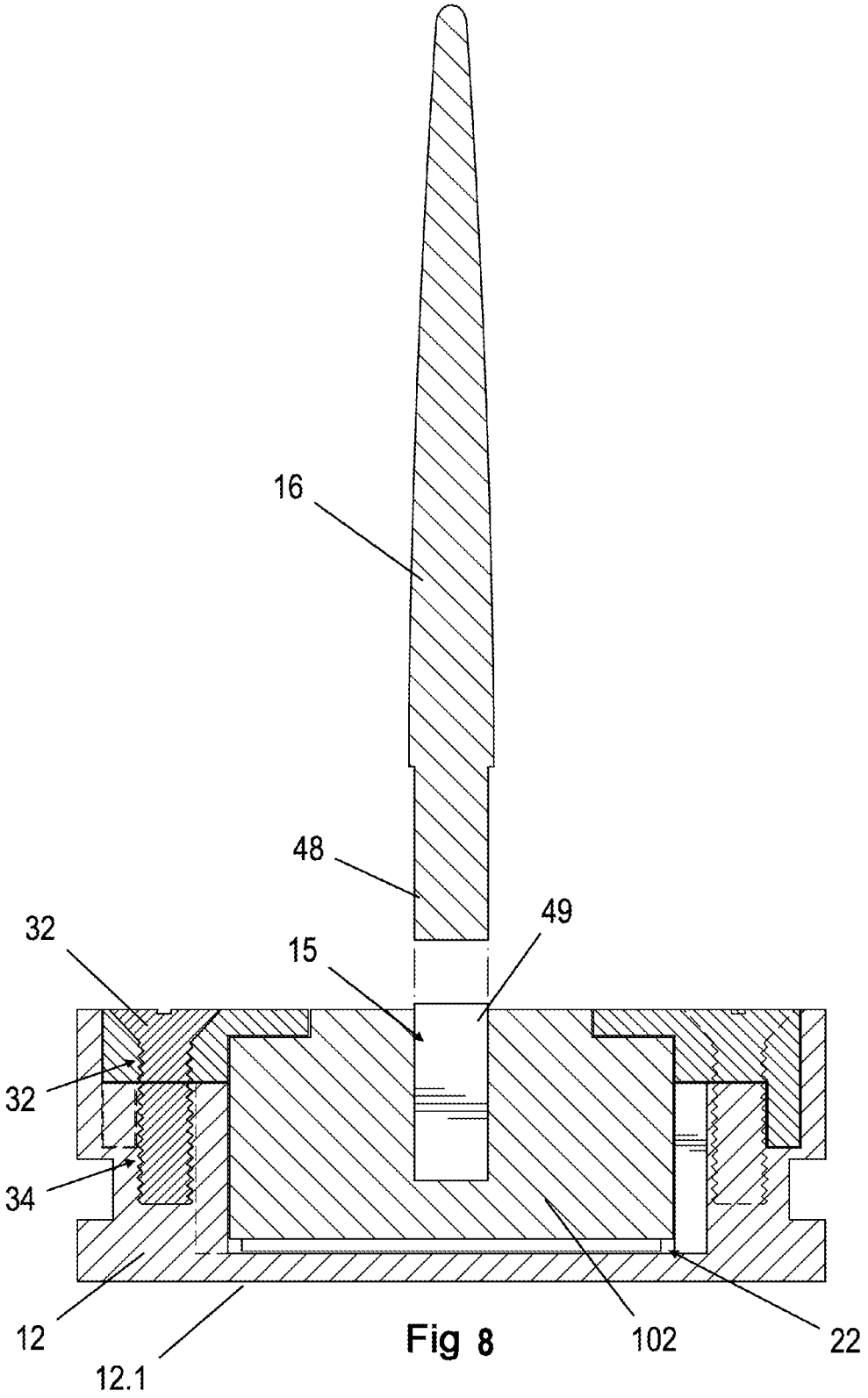
FIG. 8 shows a sectional view of the stationary fin as shown in FIG. 6.

Referring to FIGS. 6-8 an interchangeable self-aligning fin and static fin kit (100) having a stationary fin assembly is shown. The fin kit (100) includes a housing (12) and a static mechanism (102) positioned inside the housing (12). The housing includes a bottom face (12.1) which in use, is attached to the underside of a watercraft (not shown).

The stationary fin kit (10) includes a fin (16) which is attached to the static member (102), at a fin locating position (15), and extends from the housing (12). In this example, the fin (16) may either be detachable from the static member (102) as shown in FIGS. 6-8 or uniformly constructed with the static (102) and extend from the locating position (15). In use, the rotational and pivoting mechanism (14) and the static member (102) may be interchangeably used with the housing (12) providing either a movable fin or a static fin.

The static member (102) is shaped and dimensioned to match the shape and dimensions of housing's hollow interior (22) in order to restrict all movement.

In use, a surfboard may include three movable fin assemblies attached to the board. The rotation and pivoting mechanisms of each movable fin assembly may be removable. The surfboard may further include one or more static members, which are shaped and dimensioned to correspond with the interior of the housing and can replace any one or more of the rotation and pivoting mechanisms in order to restrict fin movement.

The static members and rotation and pivoting mechanisms may be interchangeably receivable by the movable fin assembly housings in order to selectively provide dynamic, static or a combination of dynamic and static fins on the underside of the surfboard.

The inventor believes that the invention provides a movable fin assembly that is capable of rotating and pivoting to accord to the different phases of trajectory while the fin is moving through the water in order to avoid a hydrodynamic stall and allows multiple fins on a surfboard or watercraft to achieve synchronized self-alignment, producing less drag in the water than a conventional multiple-fin setup, where the set alignments usually differ.

The invention claimed is:

1. A movable fin assembly, which includes:

a housing attachable to an underside of a watercraft, the housing having a hollow interior; and a rotation and pivoting mechanism positioned inside the housing, the rotation and pivoting mechanism having two movable members including a first member rotatable about one axis and a second member rotatable with the first member about said axis, and also independently rotatable about another axis, wherein the second member is shaped and dimensioned to fit inside the first member and a fin locating position is provided on the second member, wherein a fin provided at the fin locating position of the mechanism is capable of pivoting about a first axis, and rotating about a second axis, such that the fin's toe angle and camber angle changes when moving through the water.

2. The movable fin assembly as claimed in claim 1, in which the rotating and pivoting mechanism includes a fin attachment formation at the fin locating position allowing a fin to be attached to the rotating and pivoting mechanism, the fin attachment formation is in the form of at least one receptacle capable of receiving at least one protuberance on an underside of the fin.

3. The movable fin assembly as claimed in claim 1, in which the rotating and pivoting mechanism includes a fin extending from the fin locating position.

4. The movable fin assembly as claimed in claim 1, in which the first member is shaped and dimensioned to correspond to confines of the housing's hollow interior thereby to allow the mechanism to rotate about a second axis extending transversely from the underside of the watercraft, the first member further having a cavity into which the second member is receivable.

5. The movable fin assembly as claimed in claim 2, in which the cavity has a lower section having a semi-circular shape, and a lower section of the second member having a corresponding rounded shape to decrease the friction between the first and second member when the second member rotates inside the first member.

6. The movable fin assembly as claimed in claim 1, in which the housing has a planar base with a transversely extending outer rim which defines the hollow interior in which the rotating and pivot mechanism is positioned.

7. The movable fin assembly as claimed in claim 1 in which the movable fin assembly includes guiding means, which in use confines the movement of the rotation and pivoting mechanism between predefined angles in order to restrict a fin's camber and toe angle wherein guiding means are in the form of step formations extending on each inner side of transversely extending outer rim along the length of the housing.

8. The movable fin assembly as claimed in claim 7, in which the step formations increase in width towards a centre point to allow both ends of the rotation and pivoting mechanism to move sideward between the step formation, thereby allowing the mechanism to rotate about a central transverse axis between predefined angles.

9. The movable fin assembly as claimed in claim 2, in which a cavity in the first member includes a guide slot located in an upper face of the first member, the guide slot forming part of guiding means.

10. The movable fin assembly as claimed in claim 4, in which the second member includes at least one guiding formation extending from an operative upper section of the second member, the at least one guiding formation operable to slide into the guide slot which restricts the degree of rotation of the second member.

11. The movable fin assembly as claimed in claim 1, in which the housing includes one or more covers for securing the rotation and pivoting mechanism inside the hollow interior of the housing, the one or more covers providing a slot through which a fin provided at the fin locating position of the rotation and pivoting mechanism extends towards an outside of the housing.

* * * * *